US009124045B2

(12) United States Patent
Shiratori et al.

(10) Patent No.: US 9,124,045 B2
(45) Date of Patent: Sep. 1, 2015

(54) METHODS OF MANUFACTURING A CONNECTOR COMPONENT HAVING A NARROW-PITCH CONNECTOR GROUP

(71) Applicant: Japan Aviation Electronics Industry, Limited, Tokyo (JP)

(72) Inventors: Masayuki Shiratori, Tokyo (JP); Shuichi Aihara, Tokyo (JP); Masayuki Katayanagi, Tokyo (JP); Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 167 days.

(21) Appl. No.: 13/680,281

(22) Filed: Nov. 19, 2012

(65) Prior Publication Data

US 2013/0149904 A1 Jun. 13, 2013

(30) Foreign Application Priority Data

Dec. 9, 2011 (JP) ..... 2011-270470

(51) Int. Cl.

| | |
|---|---|
| ***H01R 43/04*** | (2006.01) |
| ***H01R 24/00*** | (2011.01) |
| ***H01R 43/16*** | (2006.01) |
| ***H01R 43/20*** | (2006.01) |

(Continued)

(52) U.S. Cl.

CPC ..... *H01R 23/02* (2013.01); *H01R 24/62* (2013.01); *H01R 43/16* (2013.01); *H01R 43/20* (2013.01); *H01R 2107/00* (2013.01); *Y10T 29/49222* (2015.01)

(58) Field of Classification Search

CPC ..... H01R 13/04; H01R 13/6474; H01R 13/6471; H01R 12/724; H01R 13/405

USPC ..... 29/418, 874, 876, 882–884; 264/277; 439/285, 507, 607.01

See application file for complete search history.

(56) References Cited

U.S. PATENT DOCUMENTS 4,552,423 A * 11/1985 Swengel, Jr. ..... 439/607.01
5,274,918 A * 1/1994 Reed ..... 29/882

(Continued)

FOREIGN PATENT DOCUMENTS

CN 1261215 A 7/2000
CN 201601271 U 10/2010

(Continued)

OTHER PUBLICATIONS

Korean Office Action dated Oct. 21, 2013 in Korean Application No. 10 2012-0141773 with English translation of relevant parts.

(Continued)

*Primary Examiner* — Donghai D Nguyen
(74) *Attorney, Agent, or Firm* — Collard & Roe, P.C.

(57) ABSTRACT

Preparation is made of first and second contact assemblies in each of which ends of a plurality of contacts are respectively coupled to a plurality of coupling portions of a carrier. The coupling portions of at least one of the first and second contact assemblies are bent so as to offset the contacts in a thickness direction of the carrier. Then, the first and second contact assemblies are combined together in a state where the carriers overlap each other and the contacts are aligned with and spaced apart from each other in the same plane. After integrating the contacts, the coupling portions are cut off. Then, the integrated contacts are collectively inserted into a shell.

2 Claims, 4 Drawing Sheets

(51) Int. Cl.
*H01R 24/62* (2011.01)
*H01R 107/00* (2006.01)

(56) References Cited

U.S. PATENT DOCUMENTS

| | | | | |
|---|---|---|---|---|
| 5,499,927 | A * | 3/1996 | Ohno et al. | 29/883 |
| 7,448,884 | B2 | 11/2008 | Kato et al. | |
| 7,727,028 | B1 | 6/2010 | Zhang et al. | |
| 8,137,127 | B2 | 3/2012 | Hunkins et al. | |
| 8,535,086 | B2 | 9/2013 | Hunkins et al. | |
| 8,764,464 | B2 | 7/2014 | Buck et al. | |
| 2001/0049877 | A1 | 12/2001 | Sato et al. | |
| 2006/0084320 | A1 | 4/2006 | Tanaka | |
| 2010/0136849 | A1 | 6/2010 | Kato | |

FOREIGN PATENT DOCUMENTS

| | | | |
|---|---|---|---|
| CN | 101953030 | A | 1/2011 |
| CN | 101960674 | A | 1/2011 |
| CN | 102013587 | A | 4/2011 |
| JP | 03-030274 | | 2/1991 |
| JP | 06-013154 | | 1/1994 |
| JP | 2000-150106 | A | 5/2000 |
| JP | 4439540 | | 3/2010 |
| JP | 2010-135092 | A | 6/2010 |
| JP | 2010-257907 | A | 11/2010 |
| KR | 10-2006-0054077 | A | 5/2006 |
| TW | M332299 | U | 5/2008 |
| TW | M398270 | U1 | 2/2011 |

OTHER PUBLICATIONS

Chinese Office Action dated Oct. 10, 2014 in 201210530120.3 with English translation of relevant parts.

Japanese Office Action dated May 7, 2015 in JP 2011-270470, with English translation of relevant part.

Taiwan Office Action dated Apr. 15, 2015 in TW 101141073, with English translation of relevant part.

* cited by examiner

METHODS OF MANUFACTURING A CONNECTOR COMPONENT HAVING A NARROW-PITCH CONNECTOR GROUP

This application is based upon and claims the benefit of priority from Japanese Patent Application No. 2011-270470, filed on Dec. 9, 2011, the disclosure of which is incorporated herein in its entirety by reference.

BACKGROUND OF THE INVENTION

1. Field of the Invention

The present invention relates to a method of manufacturing a connector and to a connector manufactured by the manufacturing method.

2. Description of Related Art

There is known a differential transmission system adapted to transmit a differential signal pair, comprising signals having opposite phases, in two signal lines forming a pair. Since the differential transmission system has a feature that the data transfer rate can be made high, it has recently been put to practical use in various fields.

For example, in the case of using the differential transmission system for data transfer between a device and a liquid crystal display, the device and the liquid crystal display are each provided with a display port connector which is designed according to the display port standard. As this display port standard, VESA DisplayPort Standard Version 1.0 or its Version 1.1a is known.

This display port connector is a kind of differential signal connector and has a first connection side for connection to a connection partner and a second connection side for connection to a board of the device or the liquid crystal display. The configuration of the first connection side is strictly defined by the display port standard in terms of the relationship with the connection partner while the configuration of the second connection side is relatively free. This type of differential signal connector is disclosed in Japanese Patent (JP-B) No. 4439540 (Patent Document 1) and comprises a shell and a contact group held by the shell.

The contact group disclosed in Patent Document 1 comprises, as shown in FIG. 1, three ground contacts 1 arranged at regular intervals and two pairs of signal contacts 2, each pair being arranged between the adjacent ground contacts 1. On the first connection side of the connector, first ends 1*a* of the ground contacts 1 and first ends 2*a* of the signal contacts 2 are adjacently arranged on a straight line. Then, the ground contacts 1 and the signal contacts 2 extend in parallel to each other and then are bent at a right angle in the same direction at positions offset from each other. As a consequence, on the second connection side of the connector, second ends 1*b* of the adjacent ground contacts 1 are located at both ends of the long side of a trapezoid while second ends 2*b* of the signal contacts 2 forming each pair are located at both ends of the short side of the trapezoid. Then, the second ends 1*b* of the ground contacts 1 and the second ends 2*b* of the signal contacts 2 are respectively inserted into through holes of a connection object and are connected to the connection object by soldering.

According to the contact group described above, since, on the second connection side, the second ends 1*b* of the ground contacts 1 and the second ends 2*b* of the signal contacts 2 are arranged in different rows so that the distances therebetween are increased, the operation of connecting them to the connection object is facilitated.

On the other hand, JP-A-H03-30274 (Patent Document 2) and JP-A-H06-13154 (Patent Document 3) disclose a technique that prepares a plurality of contact assemblies, as intermediate members, each having a plurality of wide-pitch contacts by pressing separate metal plates and then combines them together, thereby narrowing the array pitch of the contacts.

SUMMARY

In terms of productivity, it is advantageous to collectively manufacture the above-mentioned contact group rather than manufacture the contacts one by one. That is, the productivity is improved by punching a metal plate to form a contact assembly having a number of contacts and then manufacturing a contact group using the contact assembly.

However, a problem arises if the contact group shown in FIG. 1 is manufactured using the contact assembly described above. That is, in the developed state of the contact assembly, the second ends 2*b* of the linear signal contacts 2 are close to the linear ground contacts 1. Therefore, in the case of a small connector, it is difficult to ensure the punch width in press working and thus to form the contact group shown in FIG. 1 from the single metal plate, so that failure tends to occur, resulting in a reduction in productivity.

In view of this, in Patent Document 1, the signal contacts and the ground contacts are separately manufactured and then combined together. However, since the respective contacts are bent and separated from each other and then are aligned and inserted into the shell, the manufacturing process becomes complicated.

On the other hand, according to the technique disclosed in Patent Documents 2 and 3, coupling portions each coupling the plurality of contacts together overlap each other when the contact assemblies are combined together. As a consequence, there arises a problem that the contacts are not aligned in the same plane.

The present invention seeks to solve one or more or the above problems, or to improve upon those problems at least in part.

According to an aspect of the preset invention, there is provided a method of manufacturing a connector. The method comprises preparing a first and a second contact assembly in each of which ends of a plurality of contacts are respectively coupled to a plurality of coupling portions of a carrier, bending the coupling portions of at least one of the first and second contact assemblies to offset the contacts in a thickness direction of the carrier, combining the first and second contact assemblies together in a state where the carriers overlap each other and the contacts are aligned with and spaced apart from each other in the same plane, integrating the aligned and spaced-apart contacts and then cutting off the coupling portions, and collectively inserting the integrated contacts into a shell.

According to another aspect of the present invention, there is provided a method of manufacturing a connector. The method comprises preparing a first and a second contact assembly in each of which ends of a plurality of contacts are respectively coupled to a plurality of coupling portions of a carrier, bending the coupling portions of at least one of the first and second contact assemblies to offset the contacts in a thickness direction of the carrier, combining the first and second contact assemblies together in a state where the carriers overlap each other and the contacts are aligned with and spaced apart from each other in the same plane, integrating the aligned and spaced-apart contacts by insert molding and then cutting off the coupling portions, and collectively inserting the integrated contacts into a shell.

According to still another aspect of the present invention, there is provided a connector manufactured by each of the above-mentioned methods.

In the connector, it may be arranged that the contacts include a plurality of pairs of signal contacts and a plurality of ground contacts, that, on a first connection side for connection to a connection partner, each pair of signal contacts are arranged in a space between the adjacent ground contacts, that, on a second connection side for connection to a connection object, the ground contacts are arranged in a first row, that the signal contacts are arranged in a second row which is parallel to the first row, and that each pair of signal contacts face a space between the adjacent ground contacts, so that the signal contacts and the ground contacts form at least one trapezoidal layout on one side of the first row.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Figure 1:
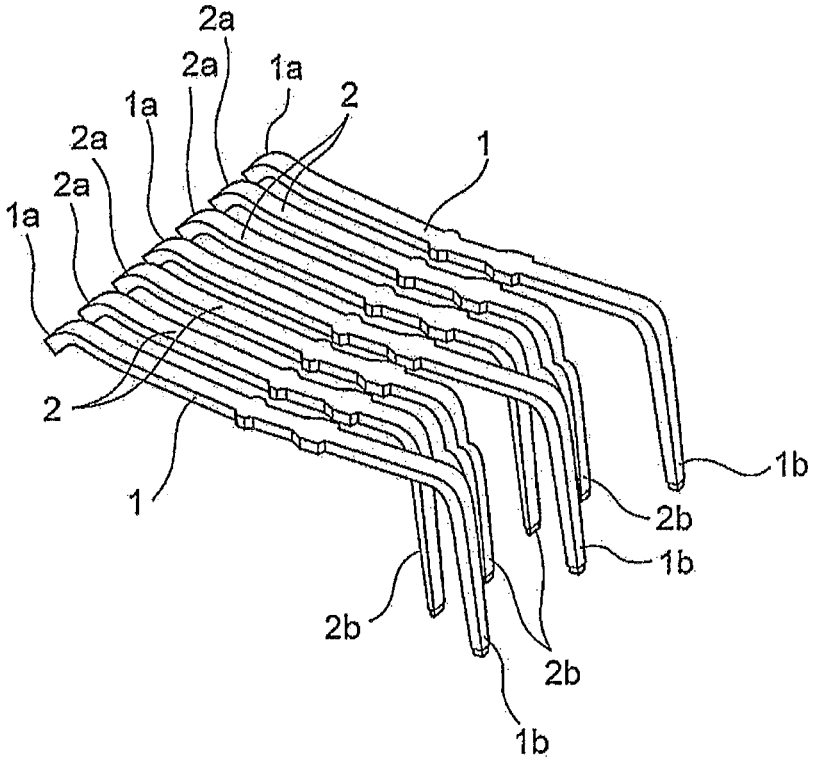
FIG. 1 PRIOR ART
FIG. 1 is a perspective view of a contact group for explaining a technique disclosed in Patent Document 1 (Japanese Patent (JP-B) No. 4439540)

Referring to the drawings, a connector manufacturing method according to an embodiment of the present invention and a connector manufactured by the manufacturing method will be described.

Figure 2A:
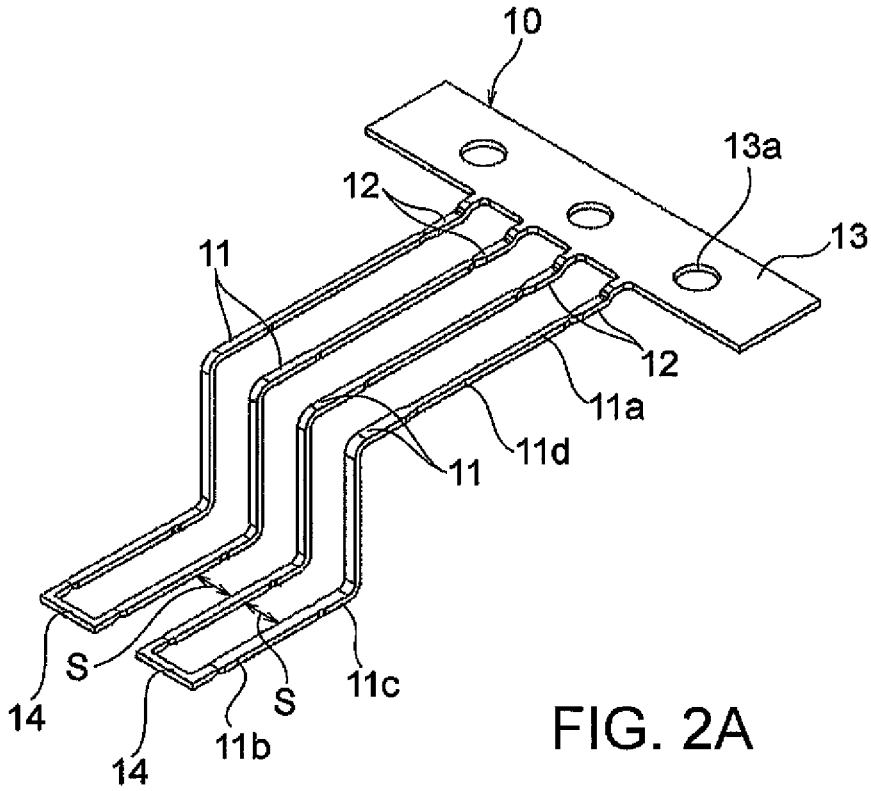
FIG. 2A is a perspective view showing a first contact assembly for use in a connector manufacturing method according to an embodiment of the present invention.
Figure 2B:
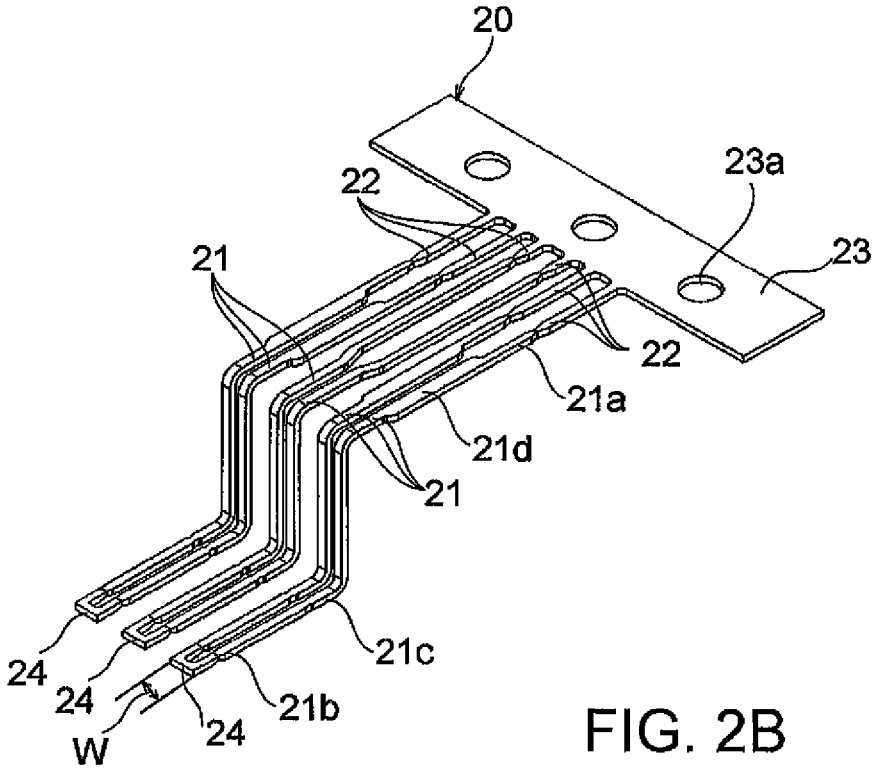
FIG. 2B is a perspective view showing a second contact assembly adapted to be combined with the first contact assembly.

First, a conductive first contact assembly 10 shown in FIG. 2A and a conductive second contact assembly 20 shown in FIG. 2B are prepared as intermediate members in the manufacture of the connector.

The first contact assembly 10 has a plurality of (four) contacts 11 which are spaced apart from each other and will serve as ground contacts. Each contact 11 has a first end 11*a* which will serve as a connecting portion (terminal portion), a second end 11*b* which will serve as a contact portion, and a holding portion 11*c* which is located between the first and second ends 11*a* and 11*b* and will be held by an insulator by insert molding. The first ends 11*a* of the contacts 11 are coupled to a carrier 13 having pilot holes 13*a* by coupling portions 12, respectively. The second ends 11*b* of the adjacent two contacts 11 are joined to each other by a joining portion 14. A space S between every adjacent two of the four contacts 11 is set to be relatively large.

Further, the coupling portions 12 of the first contact assembly 10 are bent so that the first ends 11*a* of the contacts 11 and bending scheduled portions 11*d* respectively following the first ends 11*a* are offset in a thickness direction of the carrier 13.

On the other hand, the second contact assembly 20 has a plurality of (six) contacts 21 which are spaced apart from each other and will serve as signal contacts. Each contact 21 has a first end 21*a* which will serve as a connecting portion (terminal portion), a second end 21*b* which will serve as a contact portion, and a holding portion 21*c* which is located between the first and second ends 21*a* and 21*b* and will be held by the insulator by the insert molding. The first ends 21*a* of the contacts 21 are coupled to a carrier 23 having pilot holes 23*a* by coupling portions 22, respectively. The second ends 21*b* of the adjacent two contacts 21 are joined to each other by a joining portion 24. That is, the signal contacts are divided into three pairs. The total width W of each pair of contacts 21 joined to each other by the joining portion 24 is set to be smaller than the space S between the contacts 11.

Bending is not applied to the coupling portions 22 of the second contact assembly 20 and therefore the first ends 21*a* of the contacts 21 and bending scheduled portions 21*d* respectively following the first ends 21*a* are formed to be flush with the carrier 23.

Then, the first and second contact assemblies 10 and 20 are combined together in a state where the carriers 13 and 23 overlap each other and the contacts 11 and 21 are aligned with and spaced apart from each other in the same planes. That is, while the three pairs of the joined signal contacts of the second contact assembly 20 are respectively arranged in a spaced-apart state between the four ground contacts of the first contact assembly 10, the carriers 13 and 23 are overlapped with each other.

Figure 3:
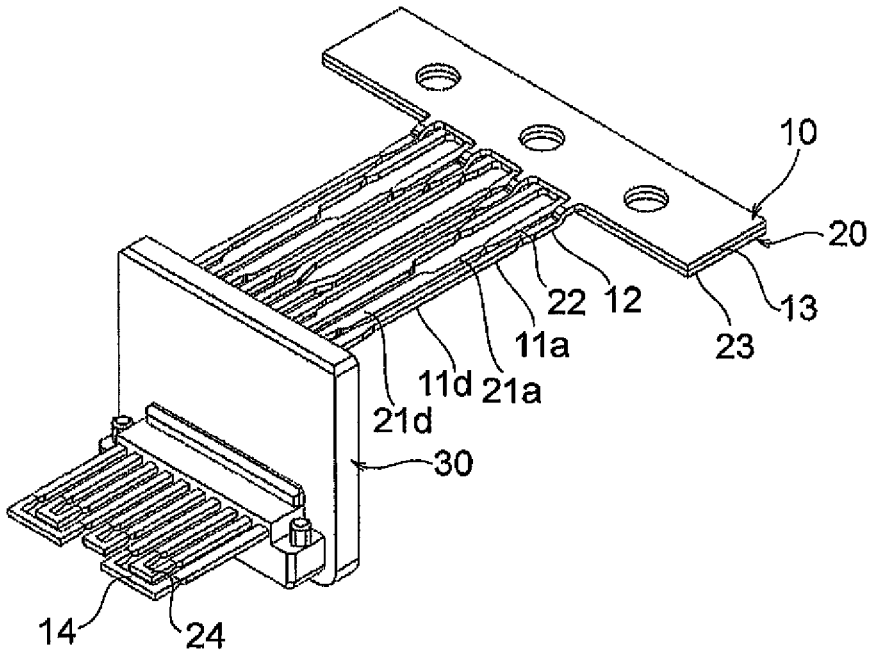
FIG. 3 is a perspective view showing a state where the first and second contact assemblies are combined together and are integrated together by a mold portion.

Further, as shown in FIG. 3, a mold portion 30 is formed by insert molding of a resin material so that the holding portions 11*c* and 21*c* (see FIGS. 2A and 2B) are firmly held in a spaced-apart state by the mold portion 30. In this event, although the carriers 13 and 23 maintain the overlapping state, since the coupling portions 12 of the first contact assembly 10 are bent so that the first ends 11*a* and the bending scheduled portions 11*d* of the contacts 11 are offset with respect to the carrier 13 in its thickness direction, the first ends 11*a* and 21*a* and the bending scheduled portions 11*d* and 21*d* of the contacts 11 and 21 can be arranged in the same plane.

Then, the coupling portions 12 and 22 of the carriers 13 and 23 and the joining portions 14 and 24 in the first and second contact assemblies 10 and 20 are cut off. As a result, all the contacts 11 and 21 are electrically isolated from each other, but are kept mechanically integrated with each other due to holding by the mold portion 30. That is, a contact group integrally held by the mold portion 30 is obtained.

Figure 4:
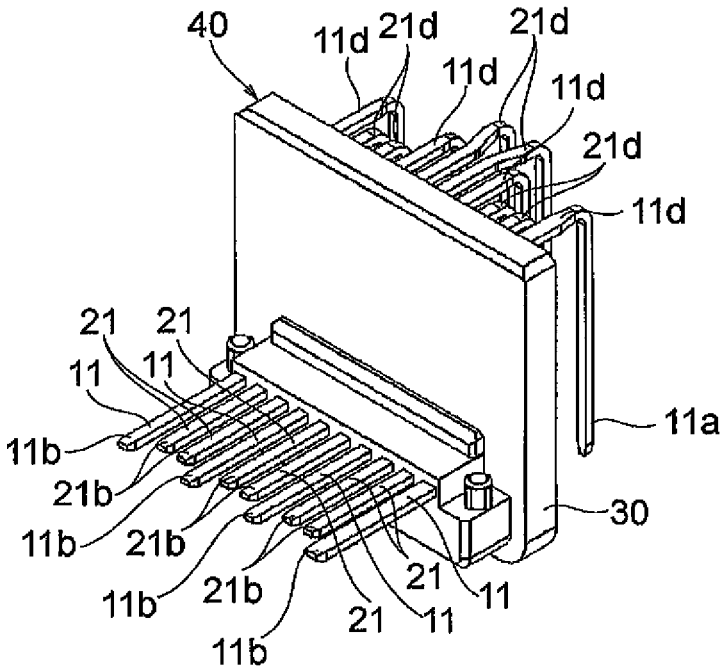
FIG. 4 is a perspective view showing a first connector component formed by cutting off unnecessary portions from the first and second contact assemblies and then bending contacts of the first and second contact assemblies as required.

Further, as shown in FIG. 4, the contacts 11 and 21 are bent as required. Specifically, the bending scheduled portions 11*d* and 21*d* of the contacts 11 and 21 are bent in predetermined shapes, thereby positioning the first ends 11*a* and 21*a* at lower portions. In this manner, a first connector component 40 having the narrow-pitch contact group is easily completed.

In the first connector component 40, on the first connection side for connection to a connection partner such as a mating connector, each pair of signal contacts are arranged in the space between the adjacent ground contacts. On the other hand, on the second connection side for connection to a connection object such as a circuit board, the ground contacts are arranged in a first row, the signal contacts are arranged in second and third rows each being parallel to the first row, and each pair of signal contacts face the space between the adjacent ground contacts, so that the signal contacts and the ground contacts form at least one trapezoidal layout on one side of the first row.

Figure 5:
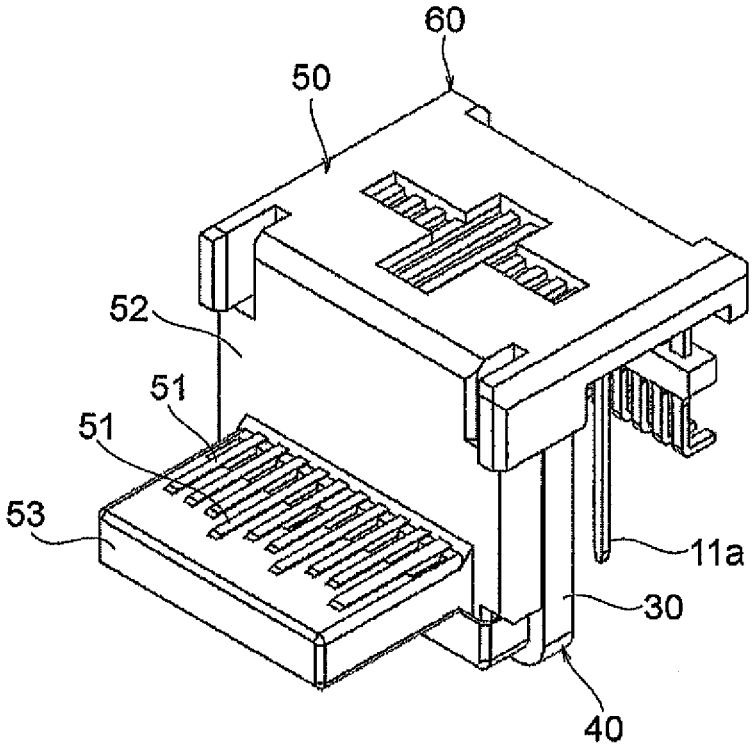
FIG. 5 is a perspective view showing a connector body formed by combining, with the first connector component, a second connector component formed by attaching contacts to a mold portion.

Then, as shown in FIG. 5, a second connector component 50 is combined with the first connector component 40 of FIG. 4, thereby forming a connector body 60. The second connector component 50 is formed by attaching a plurality of contacts 51 to a mold portion 52.

In the connector body 60, the mold portion 52 has an insulating plate portion 53 extending horizontally. The contacts 11 and 21 of the first connector component 40 (see FIG. 4) are arranged on a lower surface of the insulating plate portion 53 while the contacts 51 of the second connector component 50 are arranged on an upper surface of the insulating plate portion 53.

Figure 6:
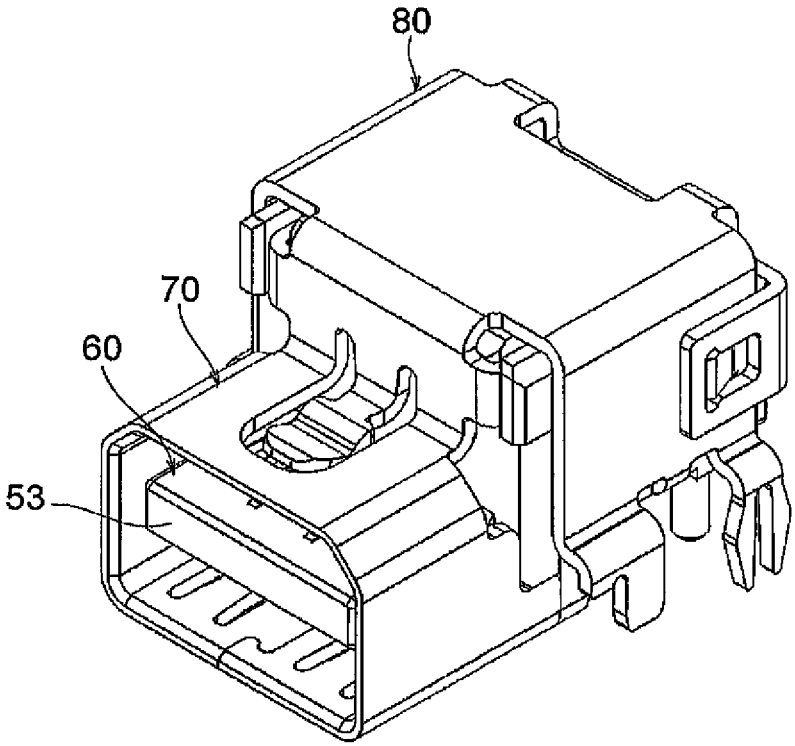
FIG. 6 is a perspective view of a connector formed by attaching the connector body of FIG. 5 to a shell.

Then, as shown in FIG. 6, the connector body 60 is attached to a shell 70. Consequently, the contacts 11 and 21 integrally held in the first connector component 40 as shown in FIG. 4 and the contacts 51 integrally held in the second connector component 50 as shown in FIG. 5 are collectively inserted into the shell 70. In this manner, a connector 80 having the narrow-pitch contact groups can be easily manufactured.

While the description has been given using the so-called mid-mount type connector which is provided so that the contact portions of the contacts are located at the edge of a circuit board as a connection object at approximately the same height level as the circuit board, the same is applicable to the type of connector that is provided on an upper or lower surface of a circuit board.

In the above-mentioned embodiment, only the coupling portions of the first contact assembly are bent. Alternatively, only the coupling portions of the second contact assembly may be bent in the opposite direction or the coupling portions of both the first and second contact assemblies may be bent in opposite directions. In summary, the coupling portions of at least one of the first and second contact assemblies are bent.

It is apparent that the present invention is not limited to the above-mentioned embodiment, but may be modified and changed without departing from the scope and spirit of the invention.

What is claimed is:

1. A method of manufacturing a connector component, comprising:

preparing a first contact assembly and a second contact assembly in each of which first ends of a plurality of contacts are respectively coupled to a plurality of coupling portions of a carrier and second ends of adjacent two of the contacts are joined to each other by a joining portion;

bending the coupling portions of at least one of the first and second contact assemblies to offset the contacts in a thickness direction of the carrier;

combining the first and second contact assemblies together in a state where the carriers overlap each other and the contacts are aligned with and spaced apart from each other in the same plane;

integrating the aligned and spaced-apart contacts and then cutting off the coupling portions and the joining portion from the contacts.

2. A method of manufacturing a connector component, comprising:

preparing a first contact assembly and a second contact assembly in each of which first ends of a plurality of contacts are respectively coupled to a plurality of coupling portions of a carrier and second ends of adjacent two of the contacts are joined to each other by a joining portion;

bending the coupling portions of at least one of the first and second contact assemblies to offset the contacts in a thickness direction of the carrier;

combining the first and second contact assemblies together in a state where the carriers overlap each other and the contacts are aligned with and spaced apart from each other in the same plane; and integrating the aligned and spaced-apart contacts by insert molding and then cutting off the coupling portions and the joining portion from the contacts.

* * * * *